US006086744A

United States Patent [19]

Zoppi

[11] Patent Number: 6,086,744

[45] Date of Patent: Jul. 11, 2000

[54] PRODUCTION OF ELECTROLYTIC COPPER FROM DILUTE SOLUTIONS CONTAMINATED BY OTHER METALS

[75] Inventor: Gianni Zoppi, Dino Di Sonvico, Switzerland

[73] Assignee: Ecochem, Aktiengesellschaft, Triesen, Liechtenstein

[21] Appl. No.: 09/135,255

[22] Filed: Aug. 17, 1998

[30] Foreign Application Priority Data

Aug. 27, 1997 [CH] Switzerland ..... 2000/97

[51] Int. Cl.[7] ..... C25D 3/04; C25D 3/06

[52] U.S. Cl. ..... 205/284; 205/288

[58] Field of Search ..... 205/580, 582, 205/583, 584, 563, 588

[56] References Cited

U.S. PATENT DOCUMENTS 1,340,826 5/1920 Greenawalt ..... 205/584
2,331,395 10/1940 Holmes ..... 205/563
5,372,684 12/1994 Zoppi ..... 205/582

*Primary Examiner*—Kathryn Gorgos
*Assistant Examiner*—Thao Tran
*Attorney, Agent, or Firm*—Oblon, Spivak, McClelland, Maier & Neustadt, P.C.

[57] ABSTRACT

The copper is selectively precipitated in the form of a sulfide from the solutions containing it, according to the reaction:

$$Cu^{2+}+S^{2-}\rightarrow CuS$$

The precipitated solid, constituted by copper sulfide, is filtered, washed and then leached with a solution of ferric fluoborate and fluoboric acid, which dissolves the copper as a fluoborate while forming elemental sulfur, according to the reaction:

$$CuS+2Fe(BF_4)_3\rightarrow Cu(BF_4)_{2+2Fe(BF4)_2}+S^o$$

After filtering off the sulfur, the copper fluoborate solution is subjected to an electrolysis in a diaphragm cell, obtaining a deposit of pure copper at the cathode and a regenerated solution of ferric fluoborate at the anode, which is utilized to leach further copper sulfide.

5 Claims, 1 Drawing Sheet

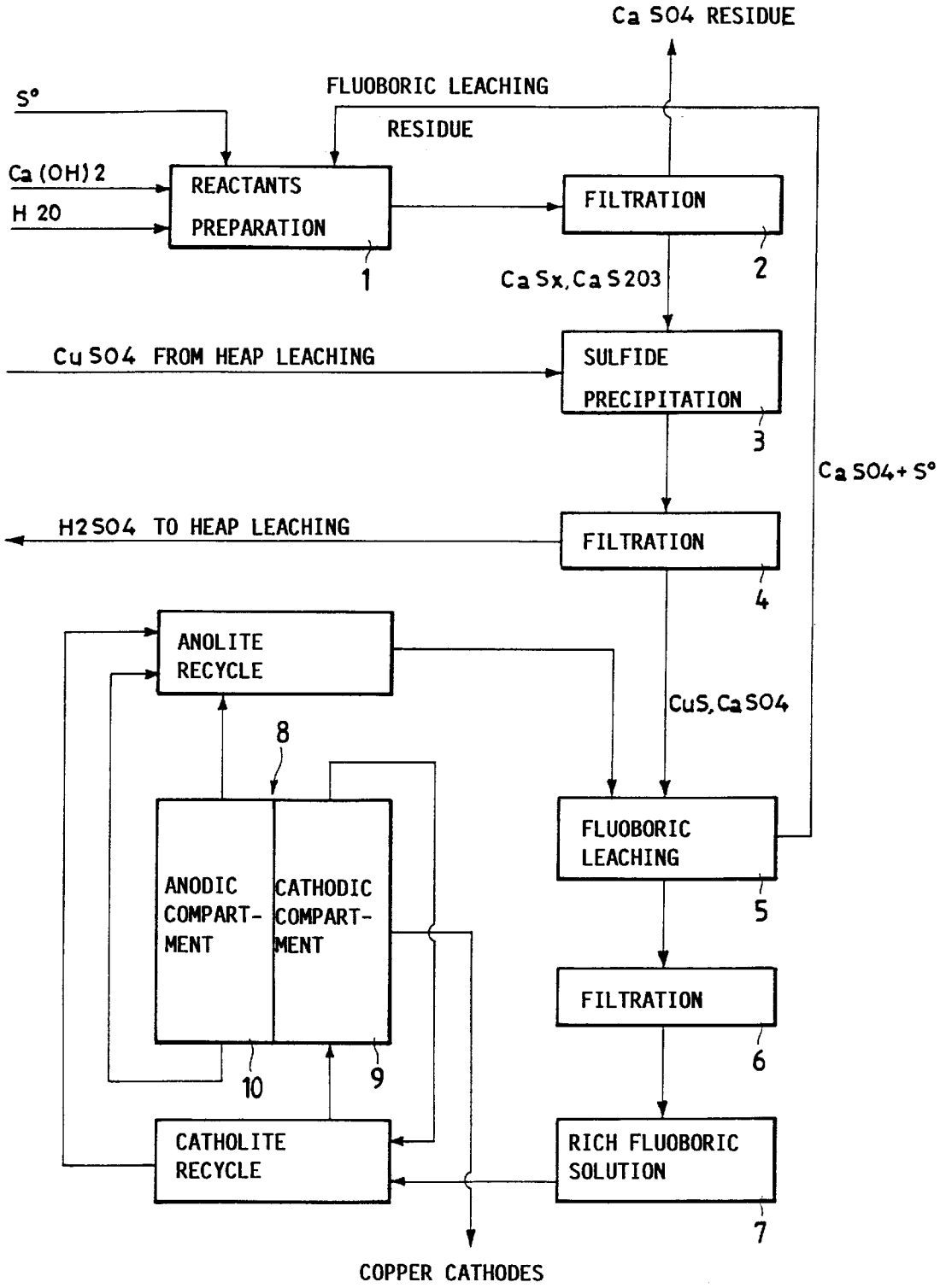
Ca SO4 RESIDUE
FLUOBORIC LEACHING
RESIDUE
S°
Ca (OH) 2
H 20
REACTANTS
PREPARATION
1
FILTRATION
2
Ca Sx, Ca S 203
Cu SO4 FROM HEAP LEACHING
SULFIDE
PRECIPITATION
3
Ca SO4+ S°
H2SO4 TO HEAP LEACHING
FILTRATION
4
ANOLITE
RECYCLE
CuS, Ca SO4
8
ANODIC
COMPART-
MENT
CATHODIC
COMPART-
MENT
FLUOBORIC
LEACHING
5
FILTRATION
6
10
9
CATHOLITE
RECYCLE
RICH FLUOBORIC
SOLUTION
7
COPPER CATHODES

PRODUCTION OF ELECTROLYTIC COPPER FROM DILUTE SOLUTIONS CONTAMINATED BY OTHER METALS

BACKGROUND OF THE INVENTION

1. Field of the Invention

A significant percentage of the world's current production of copper, about 15%, derives from a leaching process, by various systems, of minerals with a low copper content, in which the latter is present in an oxydized form insoluble in dilute sulfuric acid. The leaching solutions typically contain from 1 to 5 g/l of copper, in addition to other impurities normally found in these materials, such as iron, arsenic, bismuth, antimony, etc.; the direct electrolysis of these solutions for the purpose of producing pure copper is not practical due to both their dilution and their impurities.

2. Description of the Background

The recovery of copper from these solutions has for a long time occurred by precipitating metallic copper while using scrap iron.

Being less noble than copper, the iron replaces the latter according to the well known reaction:

$$Fe+Cu^{2+}\rightarrow Cu+Fe^{2+}$$

This operation, known as cementation, produces a fine copper precipitate requiring a successive refining process by thermal and/or electrochemical means to obtain a copper of pure commercial quality.

Other systems for precipitating copper in the sulfide form have been proposed and applied, based on using hydrogen sulfide or sodium sulfide.

The copper sulfide thus obtained was processed by classic pyrometallurgical systems such as flotation concentration.

Certain ion-exchange systems have been developed in recent years, which utilize specific organic solvents to achieve a selective extraction of copper from dilute aqueous solutions and to recover it in concentrated form from a highly acidic copper sulfate solution.

This solution constitutes the circulating electrolyte of an electrolytic system based on insoluble anodes, which deposits the copper contained in the solution on a cathode composed of a thin copper or stainless steel plate.

The deposited copper fits the purity limits requested by the standards.

The anode of this system is a lead alloy plate which evolves oxygen.

The cell voltage of this system is about 2 V, so that the energy consumption per kg of deposited copper is in the range of 1.9 to 2 kW/h.

This process, commercially known as SX-EW, normally utilizes two product classes as solvents, namely salicylaldoxime and ketoxime, diluted in a petroleum distillate such as kerosene.

This process has gradually replaced the copper precipitation system based on cementation with Fe. Compared to the cementation system, the SX-EW process has the advantage of a lower operating cost (due to the savings on the scrap iron, required in a ratio of 1.5–2 kg per kg of precipitated copper), avoids handling the ferrous sulfate solution resulting from the cementation and produces a finished copper product of the highest commercial quality.

These undoubted advantages are opposed by a higher investment cost, a highly sophisticated system operation and technical problems related to the handling of large volumes of organic substances, which may, if improperly controlled, constitute a potential ecological hazard for the surrounding environment.

In these systems, the ratio of the aqueous phase to the solvent is in fact about 1:1, which means that the production of 50 tons/day of copper requires handling a solvent volume of about 1,000 $m_3$/h.

With such volumes involved, the inevitable losses of solvent and diluent containing aromatic compounds, while relatively low compared to the copper produced (about 1 kg of solvent and 10 kg of diluent per ton of copper), release certain substances into the environment which can over the medium term certainly adversely affect the biological processes of the surrounding ecosystem.

The mentioned shortcomings are certainly not the only ones of the SX-EW technology.

The extraction of copper from the sulfate and free sulfuric acid solution occurring in an electrochemical reaction with an insoluble lead anode evolving oxygen presents additional problems from both an ecological and an economical viewpoint.

From an ecological viewpoint the oxygen evolves at the anode in the form of tiny high energy bubbles which break up when they reach the surface of the bath, forming an aerosol foam composed of acidic particles which seriously contaminate the working environment.

Although certain measures have been implemented to attenuate this shortcoming, the problems of acidic mists in the SX-EW electrolysis is ever present, with serious consequences for the health of the employees.

From an economical viewpoint, it must be pointed out that in this kind of technology the cell voltage is high due to the anodic component, and that the energy consumption per unit product is high, i.e. about 2,000 kWh per ton of copper.

Another requirement of the process is the need of maintaining about 100 g/m3 of cobalt as a sulfate in the bath by continuous additions, in order to stabilize the anode surface and prevent particles of the same from being incorporated in the cathode, with the resulting contamination of the product.

Considering the high cost of cobalt, these additions materially affect the cost of production.

In conclusion, the SX-EW process in current use and under development as a system for producing electrolytic copper from oxydized copper minerals, while being considered highly reliable, is not without significant negative aspects.

SUMMARY OF THE INVENTION

BRIEF DESCRIPTION OF THE DRAWING

The sole FIGURE is a schematic of the instant invention.

The purposes of this invention are as follows:

Producing pure electrolytic copper from dilute copper solutions, contaminated by other metals;

Eliminating the solvent extraction stage, which is currently the main system used for the selective copper extraction from these solutions;

Utilizing an electrochemical system having a lower energy consumption per unit copper produced;

Eliminating the acid fogs formed during the electrowinning phase of the traditional SX-EW process.

DETAILED DESCRIPTION OF THE PREFERRED EMBODIMENTS

These purposes and others are achieved according to this invention by a process for the production of electrolytic copper from dilute solutions containing it in an oxydized $Cu^2$+ form contaminated by other metals, characterized in that it comprises the following steps:

a) Reacting said $Cu^2$+ solution with a reagent chosen among H2S, $Na_2S$, NaHS, CaS, $Ca(HS)_2$, BaS, alkali and alkaline earths thiosulfates, thiourea and thioacetamide, as such or in a mixture, thus precipitating CuS, separated by filtration and subjected to a washing step;

b) Leaching said CuS with a solution of ferric fluoborate and fluoboric acid, according to the reaction:

$$CuS+2Fe(BF_4)_3 \rightarrow Cu(BF_4)_2+2Fe(BF_4)_2+S^o \quad (1)$$

Separating the elemental sulfur thus produced by filtration:

c) Subjecting the copper fluoborate and ferrous fluoborate solution obtained in said step (b) to an electrolysis process in a diaphragm cell in accordance with the following reactions:

At the cathode:

$$Cu(BF_4)_2+2Fe(BF_4)_2+2e^- \rightarrow Cu+2Fe(BF_4)_2+2(BF_4)^- \quad (2)$$

At the anode:

$$Cu(BF_4)_2+2Fe(BF_4)_2+2(BF_4)^- -2e^- \rightarrow Cu(BF_4)_2+2Fe(BF_4)_3 \quad (3)$$

Overall reaction:

$$Cu(BF_4)_2+2Fe(BF_4)_2+ \rightarrow Cu+2Fe(BF_4)_3 \quad (4)$$

thus producing pure electrolytic copper at the cathode.

The dilute solutions containing the copper as an ion $Cu^{2+}O$ can originate from the leaching of oxidized minerals with a low copper content, from the bacterial leaching of copper sulfides and as a product of other solubilizing processes of primary and secondary copper compounds.

These are normally sulfate, chloride or mixed solutions, containing copper in variable amounts from a few hundredths of milligrams per liter to a few tenths of grams per liter, normally from 1 to 5 g per liter.

The solutions under examination normally contain, in addition to the indicated copper quantities, also other metallic impurities harmful for the subsequent pure copper yield, such as Fe, Sb, As, Bi, Zn, Cd etc., in quantities ranging from a few tenths of milligrams per liter to various grams per liter.

The process relating to this invention selectively precipitates the copper from its solutions, so as to finally achieve its precipitation and, after a solid/liquid separation completed by an accurate washing step, a solid formed by pure copper sulfide which is then utilized in an electrochemical process aimed at producing a copper cathode of the highest commercial quality, and elemental sulfur as a byproduct.

In more detail, the copper is selectively precipitated by treating the solution with a reagent capable of supplying $S^{2-}$ and/or $HS^-$ ions, while controlling the pH of the reaction in such a manner so as not to keep it above 1.5 and maintaining at least 100 mg/l of copper in solution at the end of the reaction.

As a source of ion sulfide compounds such as H2S, $Na_2S$, NaHS, CaS, $Ca(HS)_2$, BaS, the alkaline and alkaline earth thiosulfates, thiourea and thioacetamide may be used.

The reagents preferred by the invention are those whose regeneration is possible at a limited cost, such as $H_2S$ or CaS and BaS and alkaline earth thiosulfates, while $Na_2S$ and NaHS and others, though effective for the purposes of precipitating copper sulfide, cannot be regenerated because their reaction product is in a soluble form.

The copper sulfide precipitate presents itself as a voluminous solid with a large surface area and very strong hydrophilic characteristics.

In order to achieve a good filterability, certain measures such as the presence of nuclei are essential. The presence of chloride ions is also beneficial for a good precipitation of the copper sulfide.

This structural characteristic of the precipitated copper sulfide is favorably exploited during the latter's leaching process while using an oxidizing electrolyte constituted by ferric fluoborate and fluoboric acid. The oxidation potential is in effect, contrary to the sulfides of a mineral origin, such as to make it possible to oxidize the sulfide to sulfur and solubilize the copper even at a room temperature and at a very low $Fe^{3+}/Fe^{2+}$ ratio.

The leaching reaction is as follows:

$$CuS+2Fe(BF_4)_3 \rightarrow Cu(BF_4)_2+2Fe(BF_4)_2+S^o \quad (1)$$

The reaction shown may occur on a continuous or discontinuous basis, while controlling the potential based on the ratio of $Fe^{3+}/Fe^{2+}$ in solution and on the temperature.

The process temperature is that of the exhausted electrolyte leaving the electrolytic system; there is therefore no need to heat the copper sulfide dissolving reactor. The temperature is preferably kept in the range of 40 to 60° C.; this range may also be more extensive, without compromising the results of the reaction.

After a reaction time in the range of 10 to 20', the fluoborate solution with a copper content enriched by ferrous fluoborate and containing elemental sulfur in suspension is filtered off by the usual systems, thus obtaining a solid constituted by sulfur which can be purified and then put on the market.

The limpid solution obtained, containing copper fluoborate, ferrous fluoborate and traces of ferric fluoborate, constitutes the feed of an electrochemical system equipped with one or more cells in which the anodic and cathodic compartments are separated by a diaphragm.

The cathodes are constituted by AISI 316 L stainless steel plates of 3 mm thickness, having an immersed surface area of 1 $m^2$ connected on their upper side to a copper conductor bar. The anode is constituted by graphite or another anodic material capable of withstanding fluoboric acid corrosion.

The reactions occurring in the electrolytic cell are as follows:

At the cathode:

$$Cu(BF_4)_2+2Fe(BF_4)_2+2e^- \rightarrow Cu+2Fe(BF_4)_2+2(BF_4)^- \quad (2)$$

At the anode:

$$Cu(BF_4)_2+2Fe(BF_4)_2+2(BF_4)^- -2e^- \rightarrow Cu(BF_4)_2+2Fe(BF_4)_3 \quad (3)$$

Overall reaction:

$$Cu(BF_4)_2+2Fe(BF_4)_2+ \rightarrow Cu+2Fe(BF_4)_3 \quad (4)$$

The solution leaving the anodic compartment and containing ferric fluoborate is used to leach more copper sulfides.

In order to better understand the characteristcs and the advantages of the invention, a non-limiting example of the process as substantially outlined above will be described below, while using a precipitating agent among the most economical of those listed. This example is described with reference to the flow diagram shown in the enclosed drawing.

The reactant in this example is a calcium sulfide and thiosulfate solution obtained in block 1 by dissociating the elemental sulfur in an alkaline environment according to the reaction:

$$60H^- +4S^o \rightarrow 2S^{2-}+S_2O_3^{2-}+3\ H_2O$$

After the filtration in (2), the solution of CaS and $CaS_2O_3$ is dosed to into the reactor (3) containing the solution to be recovered, composed of a dilute solution of copper sulfate also containing other metallic impurities, originating from the leaching process of oxidized copper minerals.

After adjusting the pH to values <1.5, the calcium sulfide and thiosulfate solution is introduced in a slightly underdosed quantity, so as to obtain a copper content in solution of not less than 100 mg/l at the end of the reaction.

The following reaction occurs in reactor 3:

$$2\ CaS+CaS_2O_3+3\ CuSO_4+H_2O \rightarrow 3\ CuS+3\ CaSO_4+H_2SO_4 \quad (5)$$

After decanting the CuS and $CaSO_4$ precipitate is filtered off in the filter (4) and the resulting solution is used to leach some other mineral.

The solid coming from filter (4), constituted by CuS and gypsum is after accurate washing sent to a fluoboric leaching process (5), where the copper passes in solution while forming elemental sulfur according to the reaction:

$$CuS+2Fe(BF_4)_3+CaSO_4 \rightarrow Cu(BF_4)_2+2Fe(BF_4)_2+S+CaSO_4 \quad (1')$$

After filtration (6), the resulting solid, composed of elemental sulfur and calcium sulfate which has remained unchanged during the leaching process (5) after washing, is sent to a reagent regenerating phase occurring in the reactor (1), while adding calcium hydroxide and make-up sulfur, at a temperature in the range of 80 to 90° C.

The sulfur of the residual and the sulfur added to compensate for the losses is dissociated in soluble sulfide and calcium thiosulfate; the recycled gypsum remains unchanged and is expelled from the cycle during the filtration phase (2).

The copper fluoborate solution (7) obtained after filtration (6) constitutes the feed of the electrochemical system (8) formed by a diaphragm cell, where pure copper precipitates in the cathodic compartment (9) and an anodic oxidation of ferrous to ferric ion occurs in the anodic compartment (10), which reconstitutes the oxidizing power of the fluoboric solution needed to leach some more copper sulfide in the reactor (5).

The process described above utilizes as a precipitant calcium sulfide and thiosulfate produced by dissociating the sulfur with calcium hydrate.

Because this reaction utilizes as a sulfur source the sulfur produced during the oxidizing leaching of the precipitated copper sulfide, the only reagent used in practice is the calcium hydrate, a widely diffused and low-cost product.

In a different embodiment of the invention, a copper precipitating reagent is barium sulfide, which is recovered from the solution as a sulfate and can thermally again be reduced to barium sulfide by carbon. In this case the only reagent is carbon, as can better be seen in the following reactions involved:

Precipitation:

$$CuSO_4+BaS \rightarrow BaSO_4+CuS \quad (6)$$

Leaching:

$$BaSO_4+CuS+2Fe^{3+} \rightarrow BaSO_4+Cu^{2+}+2Fe^{2+}+S \quad (7)$$

Filtration:

$$BaSO_4+S+Cu^{2+}+2Fe^{2+} \rightarrow BaSO_4+S+\text{solution} \quad (8)$$

S-recovery:

By ammonium sulfide or perchloroethylene, by flotation, etc.

Reduction:

$$BaSO_4+4C \rightarrow BaS+4CO \quad (9)$$

This invention can in even greater detail be illustrated by the following non-limiting quantitative examples.

EXAMPLE 1

Complete Cycle

Precipitation with sulfide and calcium thiosulfate (copper as sulfate).

A synthetic solution reproducing a solution originating from a leaching process on an oxidized copper mineral was prepared for the purpose of producing a precipitation of copper in the form of a sulfide.

The mentioned solution had the following composition:

| | |
|---|---|
| Cu | 4.67 g/l |
| Fe | 2.40 g/l |
| As | 0.12 g/l |
| Sb | 0.23 g/l |
| Bi | 0.06 g/l |
| Zn | 1.20 g/l |
| Cd | 0.10 g/l |
| $H_2SO_4$ | 27.00 g/l |

All the metals were present as sulfates.

9.5 g of S and 5.5 g of $Ca(OH)_2$ were suspended in H2O and brought to the boiling point. After 40' a dark orange colored solution with a tiny quantity of suspended solids was obtained. These solids were filtered off and the resulting limpid solution was admixed to the sulfate solution previously described. This resulted in a dark slurry which was filtered to obtain 1.15 l of a filtrate having the following composition:

| | |
|---|---|
| Cu | 0.15 g/l |
| Fe | 1.77 g/l |
| As | 0.10 g/l |
| Sb | 0.19 g/l |
| BI | 0.05 g/l |
| Zn | 0.99 g/l |
| Cd | 0.08 g/l |
| $H_2SO_4$ | 23.00 g/l |

The moist cake weighing 33.26 g was added to 1.0 of a fluoboric solution containing $Fe^{3+}$ and saturated with $CaSO_4$ in order to leach the copper. The initial composition of the solution was as follows:

| | |
|---|---|
| Cu | 18.3 g/l |
| $Fe^{2+}$ | 33.0 g/l |
| $Fe^{3+}$ | 7.8 g/l |

The leaching process lasted 1 hour at 50° C. At the end the slurry was filtered off, obtaining 1 l of solution having the following composition:

| | |
|---|---|
| Cu | 22.7 g/l |
| $Fe^{2+}$ | 40.7 g/l |
| $Fe^{3+}$ | 0.05 g/l |

None of the impurities contained in the sulfuric solution were transferred to the fluoboric solution, because they were not present in the leached solids even at minimal quantities. The residual of the fluoboric leaching process weighed 20.5 g. It was placed in sulfur-saturated perchloroethylene at 20° C. and kept at 50° C. for 10'. The filtration yielded 12.17 g of solids, practically all $CaSO_4.2H_2O$, and 8.27 g of S after cooling the solution to room temperature.

The fluoboric solution was fed to a cell divided by a microporous diaphragm in the cathodic compartment.

A solution having a composition similar to the foregoing before the leaching process, containing all the Fe in a reduced bivalent form, was fed to the cathodic compartment.

The cathode was a platelet made of AISI 316L with a useful immersed surface of 26 $cm^2$, facing a graphite anode of the same surface. A current of 0.65 A at a cell voltage of 1.3 V was supplied for several hours, obtaining 4.45 g of Cu in form of a thin, very smooth and compact plate, and an anodic solution having the following composition:

| | |
|---|---|
| Cu | 18.5 g/l |
| $Fe^{2+}$ | 32.8 g/l |
| $Fe^{3+}$ | 8.00 g/l |

The yield of the copper deposition was 96.6% and the direct current energy consumption was of 1,136 kWh/t of Cu.

EXAMPLE 2

Precipitation of CuS (copper as sulfate)

18.9 g of $BaSO_4$ were placed in a mortar together with 4.7 g of carbon, and ground to obtain a good mixture. The resulting mixture was placed in a capsule and covered with 1.9 g of powdered carbon. The whole was put in a muffle at 1,110° C. for one hour. After cooling the powder was leached with water, obtaining 100 cc of a solution containing 117 g/l of BaS and a residue of about 3 g. The yield of the reduction process was 85%. The unreduced residual of $BaSO_4$ could be recycled to the reduction process. The resulting solution was admixed to 1.0 l. of a sulfate solution as previously described in the example 1.

This produced a dark slurry which was filtered off to obtain 1.10 l. of filtrate having the following composition:

| | |
|---|---|
| Cu | 0.26 g/l |
| Fe | 2.25 g/l |
| As | 0.11 g/l |
| Sb | 0.21 g/l |
| Bi | 0.06 g/l |
| Zn | 1.06 g/l |
| Cd | 0.09 g/l |
| $H_2SO_4$ | 24.7 g/l |

The moist cake weighing 28.22 g had the following composition:

| | |
|---|---|
| $BaSO_4$ | 16.2 g reduced to BaS by carbon |
| CuS | 6.6 g leached in the fluoborate solution |
| Moisture | 22.7% |

EXAMPLE 3

Precipitation of CuS (copper as chloride)

A synthetic solution reproducing a possible solution originating from a leaching process on an oxidized copper mineral was prepared to be subjected to a precipitation of Cu in the form of a sulfide.

This solution had the following composition:

| | |
|---|---|
| Cu | 4.22 g/l |
| Fe | 2.27 g/l |
| As | 0.16 g/l |
| Sb | 0.28 g/l |
| Bi | 0.09 g/l |
| Zn | 1.14 g/l |
| Cd | 0.12 g/l |
| HCl | 19.0 g/l |

All the metals were present as chlorides.

From a gas cylinder, H2S was bubbled through a fritted glass into the hydrochloric solution, while controlling its volume by a flowmeter, until reaching 2.31 g at the end of the test. This produced a dark slurry, which was filtered off to obtain 1.0 l of filtrate having the following composition:

| | |
|---|---|
| Cu | 0.12 g/l |
| Fe | 2.28 g/l |
| As | 0.17 g/l |
| Sb | 0.27 g/l |
| Bi | 0.09 g/l |
| Zn | 1.13 g/l |
| Cd | 0.11 g/l |
| HCl | 23.9 g/l |

The practically pure cake weighed after drying 8.12 g and was constituted by CuS.

What is claimed is:

1. A process for producing electrolytic copper from a dilute solution containing the same in an oxidized $Cu^{2+}$ form contaminated by other metals, which comprises:

a) reacting said $Cu^{2+}$ solution with a reagent, comprising $H_2S$, $Na_2S$, NaSH, CaS, $Ca(SH)_2$, BaS, alkali thiosulfates, alkaline earth thiosulfates, thiourea, or thioacetamide, or a mixture thereof, thereby precipitating CuS, and separating said CuS by filtration;

b) leaching said CuS with a solution of ferric fluoroborate and fluoroboric acid, according to the reaction:

$$CuS+2Fe(BF_4)_3 \rightarrow Cu(BF_4)_2+2Fe(BF_4)_2+S^0 \quad (1)$$

and separating the elemental sulfur thus produced by filtration; and c) subjecting the copper fluoroborate and ferrous fluoroborate solution obtained in step b) to cell-diaphragm electrolysis, in accordance with the following reactions:

at the cathode:

$$Cu(BF_4)_2+2Fe(BF_4)_2+2e^- \rightarrow Cu+2Fe(BF_4)_2+2(BF_4)^- \quad (2)$$

at the anode:

$$Cu(BF_4)_2+2Fe(BF_4)_2+2(BF_4)^{-2}-e^- \rightarrow Cu(BF_4)_2+2Fe(BF_4)_3 \quad (3)$$

overall reaction:

$$Cu(BF_4)_2+2Fe(BF_4)_2 \rightarrow Cu+2Fe(BF_4)_3 \quad (4)$$

thereby producing electrolytic copper at the cathode.

2. The process of claim 1, wherein in step a), said reagent is a solution of CaS (calcium sulfide) and $CaS_2O_3$ (calcium thiosulfate) and said $Cu^{2+}$ solution is of $CuSO_4$, whereby the following CuS precipitation reaction occurs:

$$2CaS+CaS_2O_3+3CuSO_4+H_2O \rightarrow 3CuS+3CaSO_4H_2SO_4 \quad (5).$$

3. The process of claim 1, wherein in step a), said reagent is BaS (barium sulfide), and said $Cu^{2+}$ solution is of $CuSO_4$, whereby the following CuS precipitation reaction occurs:

$$CuSO_4+BaS \rightarrow BaSO_4+CuS \quad (6)$$

and further wherein said barium sulfide is regenerated by $BaSO_4$ according to the reaction:

$$BaSO_4+4C \rightarrow BaS+4CO \quad (9).$$

4. The process of claim 2, wherein in step a), pH is maintained at a maximum value of 1.5.

5. The process of claim 1, wherein said other contaminating metals comprise Fe, Sb, As, Bi, Zn or Cd.

* * * * *